US010843901B2

(12) United States Patent
Hoedjes

(10) Patent No.: US 10,843,901 B2
(45) Date of Patent: Nov. 24, 2020

(54) STAIRLIFT

(71) Applicant: Handicare Stairlifts B.V., Heerhugowaard (NL)

(72) Inventor: Johannes Gerardus Cornelis Hoedjes, Heerhugowaard (NL)

(73) Assignee: HANDICARE STAIRLIFTS B.V., Heerhugowaard (NL)

( * ) Notice: Subject to any disclaimer, the term of this patent is extended or adjusted under 35 U.S.C. 154(b) by 385 days.

(21) Appl. No.: 15/519,182

(22) PCT Filed: Nov. 3, 2015

(86) PCT No.: PCT/NL2015/050766
§ 371 (c)(1),
(2) Date: Apr. 14, 2017

(87) PCT Pub. No.: WO2016/072849
PCT Pub. Date: May 12, 2016

(65) Prior Publication Data

US 2017/0233223 A1 Aug. 17, 2017

(30) Foreign Application Priority Data

Nov. 7, 2014 (NL) ..... 2013754

(51) Int. Cl.
*B66B 9/08* (2006.01)

(52) U.S. Cl.
CPC ..... *B66B 9/0815* (2013.01); *B66B 9/08* (2013.01); *B66B 9/0838* (2013.01); *B66B 9/0846* (2013.01)

(58) Field of Classification Search
CPC ..... B66B 9/08; B66B 9/0838; B66B 9/0815; B66B 9/0846
See application file for complete search history.

(56) References Cited

U.S. PATENT DOCUMENTS

| | | | | |
|---|---|---|---|---|
| 6,155,382 | A * | 12/2000 | Duijnstee | B66B 9/0838 187/200 |
| 8,607,936 | B2 * | 12/2013 | Szentistvany | B66B 9/0838 104/230 |
| 2011/0024237 | A1 * | 2/2011 | Vroegindeweij | B66B 9/0838 187/201 |
| 2014/0083801 | A1 * | 3/2014 | Vroegindeweij | B66B 9/0815 187/201 |

FOREIGN PATENT DOCUMENTS

| | | | | |
|---|---|---|---|---|
| CA | 2339743 | A1 * | 9/2002 | B66B 9/0838 |
| EP | 1 125 882 | A1 | 8/2001 | |
| EP | 1 449 801 | A1 | 8/2004 | |

(Continued)

*Primary Examiner* — Diem M Tran
(74) *Attorney, Agent, or Firm* — Hoffman & Baron, LLP

(57) ABSTRACT

A stairlift for moving along a staircase having: a curved rail having a centre line, a load bearing surface, and a carriage including a first and a second guiding unit connected to each other by a connecting unit. The second guiding unit is connected to the connecting unit via a third rotation joint about a third axis and a fourth joint about a fourth axis, the connection unit includes a fifth rotation joint about a fifth axis. The fifth axis extending from outside the rail to an area close to or on the centre line of the rail in a first plane close to or on the third and the fourth axis.

12 Claims, 7 Drawing Sheets

(56) References Cited

FOREIGN PATENT DOCUMENTS

| | | | | | |
|---|---|---|---|---|---|
| EP | 2452909 | A1 * | 5/2012 | ..... | B66B 9/0807 |
| FR | 2898854 | A1 * | 9/2007 | ..... | B66B 9/0815 |
| JP | 2014-129171 | A | 7/2014 | | |
| WO | 2007/046690 | A1 | 4/2007 | | |
| WO | 2008/047116 | A1 | 4/2008 | | |
| WO | 2012/093941 | A1 | 7/2012 | | |
| WO | 2014/098575 | A1 | 6/2014 | | |

* cited by examiner

STAIRLIFT

CROSS-REFERENCE TO RELATED APPLICATIONS

This application is the National Stage of International Application No. PCT/NL2015/050766 filed Nov. 3, 2015, which claims the benefit of Netherlands Application No. NL 2013754, filed Nov. 7, 2014, the contents of which is incorporated by reference herein.

FIELD OF THE INVENTION

The invention relates to a stairlift for moving a load, such as a person or goods, along a staircase. The stairlift comprises:

a curved rail configured to extend along the staircase and having a centre line, a carriage for moving the load along the rail, which carriage comprises a first and second guiding unit engaging the rail, wherein the first and second guiding unit engage the rail at a distance from each other when seen in a direction along the rail, the first guiding unit and the second guiding unit are connected to each other by a connecting unit, the first guiding unit is connected to the connecting unit via a first rotation joint having a first degree of freedom about a first axis and a second rotation joint having a second degree of freedom about a second axis, the second guiding unit is connected to the connecting unit via a third rotation joint having a third degree of freedom about a third axis and a fourth joint having a fourth degree of freedom about a fourth axis, the connection unit comprises a fifth rotation joint having a fifth degree of freedom about a fifth axis allowing the first guiding unit and the second guiding unit to rotate relative to each other.

BACKGROUND OF THE INVENTION

EP1125882, WO2007/046690 and WO2012/093941 disclose stairlifts in which the guiding units may be rotated with respect to each other. WO2012/093941 discloses a transport unit for climbing or descending a slope or stairs along a rail provided with a strip, the transport unit comprises a main frame and a guide mechanism. The guide mechanism may have at least two guides which guide the transport unit along the rail and a drive mechanism with a drive wheel for driving the transport unit along the rail by engaging the strip at an engagement point. The transport unit is provided with bearings for rotation of at least one of the guide mechanism about a first and second axis, the first and second axis being perpendicular to the rail. The guide mechanisms are connected to each other via a rotational bearing with an axis parallel to, and on a distance from the rail. Rotation about the rail therefore causes displacement of the transport unit and therefore unwanted movements of the transport unit which may disturb a person using the stairlift.

SUMMARY OF THE INVENTION

It is an objective of the invention to provide a stairlift which is less sensitive to rotations of the guide unit Accordingly there is provided a stairlift for moving a load, such as a person or goods, along a staircase, which stairlift comprises:

a curved rail configured to extend along the staircase and having a centre line, a carriage for moving the load along the rail, which carriage comprises a first and a second guiding unit engaging the rail, wherein the first and the second guiding unit engage the rail at a distance from each other when seen in a direction along the rail, the first and the second guiding unit are connected to each other by a connecting unit, the first guiding unit is connected to the connecting unit via a first rotation joint having a first degree of freedom about a first axis and a second rotation joint having a second degree of freedom about a second axis, the second guiding unit is connected to the connecting unit via a third rotation joint having a third degree of freedom about a third axis and a fourth joint having a fourth degree of freedom about a fourth axis, the connection unit comprises a fifth rotation joint having a fifth degree of freedom about a fifth axis allowing the first guiding unit and the second guiding unit to rotate relative to each other, wherein the fifth joint is being constructed and arranged with the fifth axis extending from outside the rail to an area close to or on the centre line of the rail in a first plane close to or on the third and the fourth axis.

By having the fifth joint being constructed and arranged so that the fifth axis extends from outside the rail to an area close to or on the centre line of the rail in a first plane close to or on the third and the fourth axis any rotations of the second guiding unit around the rail will not cause a displacement or rotation of the connecting unit. The stairlift will therefore run more smoothly over the rail and not disturb the user.

According to a further object the fifth joint comprises a rotational bearing being positioned at a distance from the rail.

By having a rotational bearing positioned at a distance from the rail a compact design of the stairlift becomes possible. A simple rotational bearing guarantees good manufacturability and less sensibility to wear.

According to a further embodiment the third and fourth joint are constructed and arranged so that the third and fourth axis substantially cross each other in the first plane.

In this way any rotations about the third and fourth axis will not cause any displacements of the carriage.

According to a further embodiment the third and fourth joint are constructed and arranged so that the third and fourth axis substantially cross the centre line of the rail.

By having the third and fourth axis substantially cross the centre line of the rail there is no displacement of the carriage caused by a rotation of the second guiding unit.

According to a further embodiment the third, fourth and fifth axis substantially cross through the centre line of the rail.

By having the fifth joint being constructed and arranged so that the fifth axis crosses the third, fourth and the centre line of the rail any rotations of the second guiding unit will not cause a displacement of the connecting unit.

According to a further embodiment the first, second, third and fourth joint comprise rotational bearings.

By having rotational bearings, standard available components can be used, being more compact, cheap and less sensible to wear. A simple rotational bearing guarantees good manufacturability and is less sensible to wear.

According to a further embodiment the connection unit comprises a sixth rotation joint having a sixth degree of freedom about a sixth axis allowing the first guiding unit and the second guiding unit to rotate relative to each other, the sixth rotation joint being constructed and arranged with the sixth axis extending from outside the rail to an area close to or on the centre line of the rail in a second plane close to or on the first and the second axis.

By having the sixth joint being constructed and arranged so that the sixth axis extends from outside the rail to an area close to or on the centre line of the rail in a plane close to or on the first and the second axis any rotations of the first guiding unit will not cause a displacement of the connecting unit. The stairlift is prevented from rotation around the rail by at least one guide. Especially stairlifts are used both at the left side and right side of a stair. By adding this sixth rotation axis, the rail production for both left handed placements and right handed placements can be mirror symmetric. The unit is also usable for both left and right handed placement.

According to an embodiment the first and second joint are constructed and arranged so that the first and second axis substantially cross each other in the second plane.

In this way any rotations about the first and second axis will not cause any displacements of the carriage.

According to an embodiment the first and second joint are constructed and arranged so that the first and second axis substantially cross the centre line of the rail. This makes it possible to rotate the first guide without moving the rotation point out of the centre from the rail. This further prevents the load to be moved relative from the rail, when the guide rotates.

According to an embodiment the first, second and sixth joint are constructed and arranged so that the first, second and sixth axis substantially cross through the centre line of the rail.

By having the sixth joint being constructed and arranged so that the sixth axis crosses the first axis, the second axis, and the centre line of the rail any rotations of the first guiding unit will not cause a displacement of the connecting unit.

According to an embodiment of the invention the fifth rotation joint is provided with a rotation limiter for limiting the rotation about the fifth axis. This enables the load in some cases, especially in the case of straight segments of the guide rail, to divide the load on the first and second guide better.

According to an embodiment the sixth rotation joint is provided with a rotation limiter for limiting the rotation about the sixth axis.

According to an embodiment the limiter for limiting the rotation about the fifth and or sixth axis comprises a stop.

A stop provides a simple limiter for the rotations about the fifth and or sixth axis.

According to an embodiment at least one of the first and the second guiding unit is provided with a motor driving a gear wheel which is constructed and arranged to engage with a rack provided to the rail to move the carriage up and down the rail.

According to an embodiment the first and second joints are connected with a bracing providing for a simple design of the stairlift.

According to an embodiment the third and fourth joints are connected with a bracing providing for a simple design of the stairlift.

According to an embodiment at least one of the first, the second, the third and the fourth joint are provided with double rotational bearings each rotational bearing provided on opposite sides of the rail.

By providing two rotational bearings on opposite side of the rail a stabile rotational joint may be provided about the respective axis.

According to an embodiment close is defined as preferably within 25 cm, more preferably within 5 cm and most preferably within 1 cm.

According to an embodiment the rail has one of a circular, elliptical, and polygonal cross section.

According to an embodiment the first guiding unit, prevents the carriage to rotate around the guide rail.

BRIEF DESCRIPTION OF THE DRAWINGS

Embodiments of the stairlift will be described by way of example only, with reference to the accompanying schematic drawings in which corresponding reference symbols indicate corresponding parts, and in which.

DETAILED DESCRIPTION OF THE INVENTION

Figure 1:
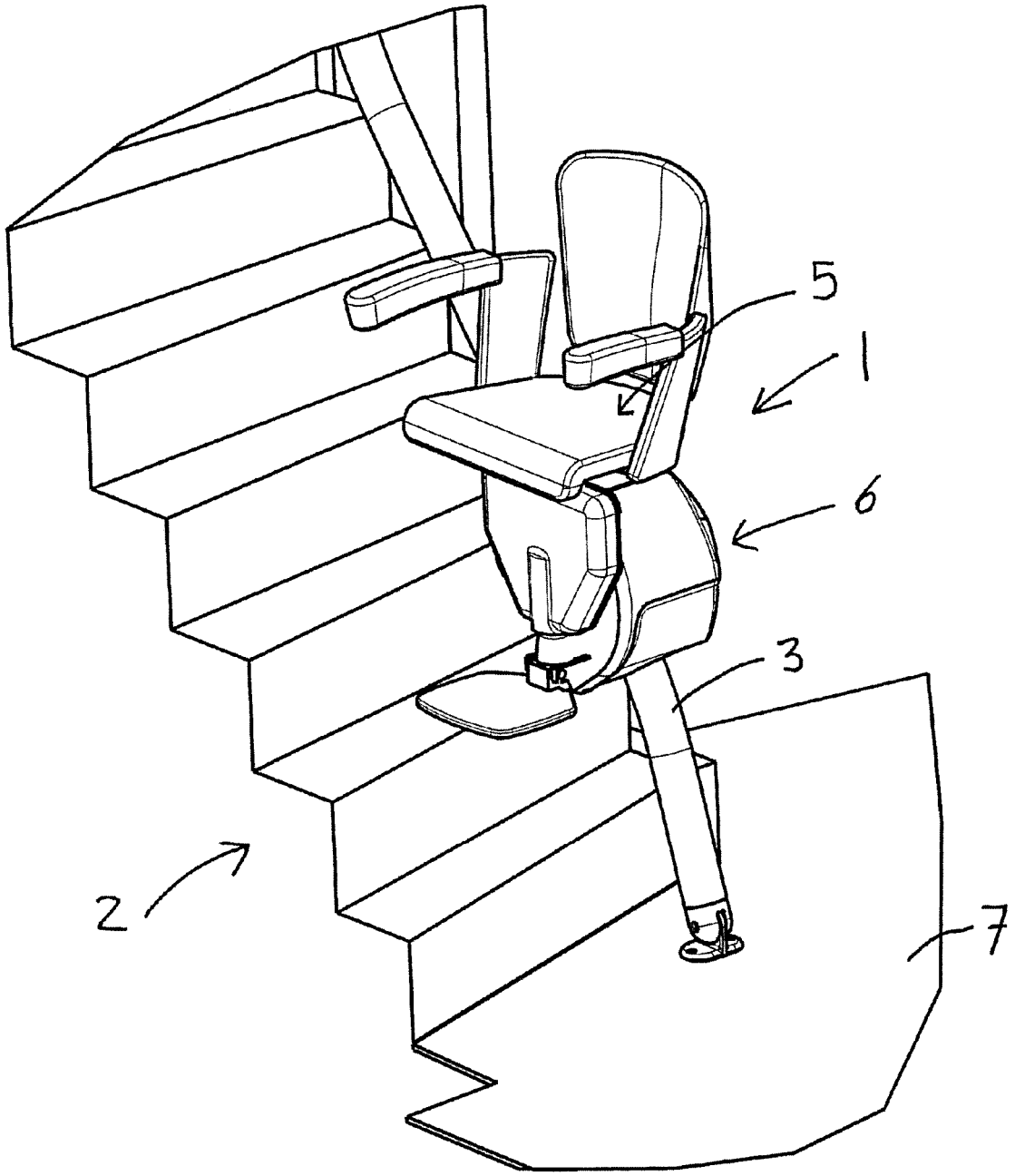
FIG. 1 schematically shows a view in perspective of the stairlift for using a carriage according to the invention, FIG. 2 schematically shows a view in perspective of the stairlift of FIG. 1 when moving along a curved section of the rail, FIGS. 3-6 schematically show a view in perspective of the carriage according to an embodiment of the invention for use in the stairlift of FIG. 1 at different angles, and FIGS. 7 and 8 schematically show a view in perspective of the carriage according to a further embodiment of the invention for use in the stairlift of FIG. 1 at different angles.

FIG. 1 shows a view in perspective of a stairlift 1 for using a carriage according to the invention. The stairlift 1 is configured to move a load, such as a person or goods, along a staircase 2. The stairlift 1 comprises a curved rail 3 extending along the staircase 2 and having a centre line 4. The stairlift 1 comprises a load bearing surface 5 to carry the load. The load bearing surface 5 is formed by a seat of a chair. In an another example of the stairlift 1, the load bearing surface 5 is formed by a platform. The stairlift 1 comprises a carriage 6 to move the load bearing surface 5 along the rail 3. The carriage 6 may be covered by a carriage housing.

Figure 2:
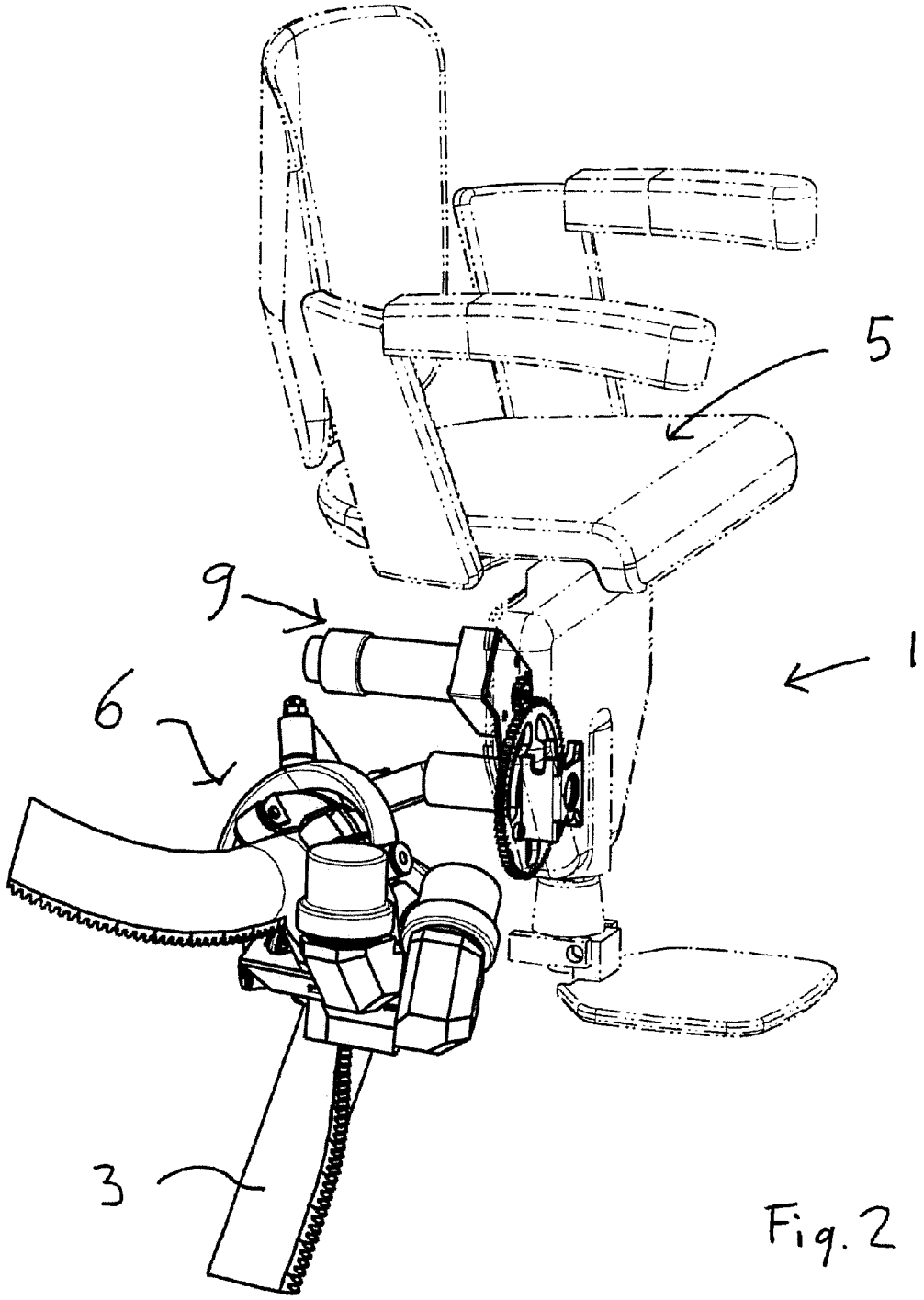
Figure 3:
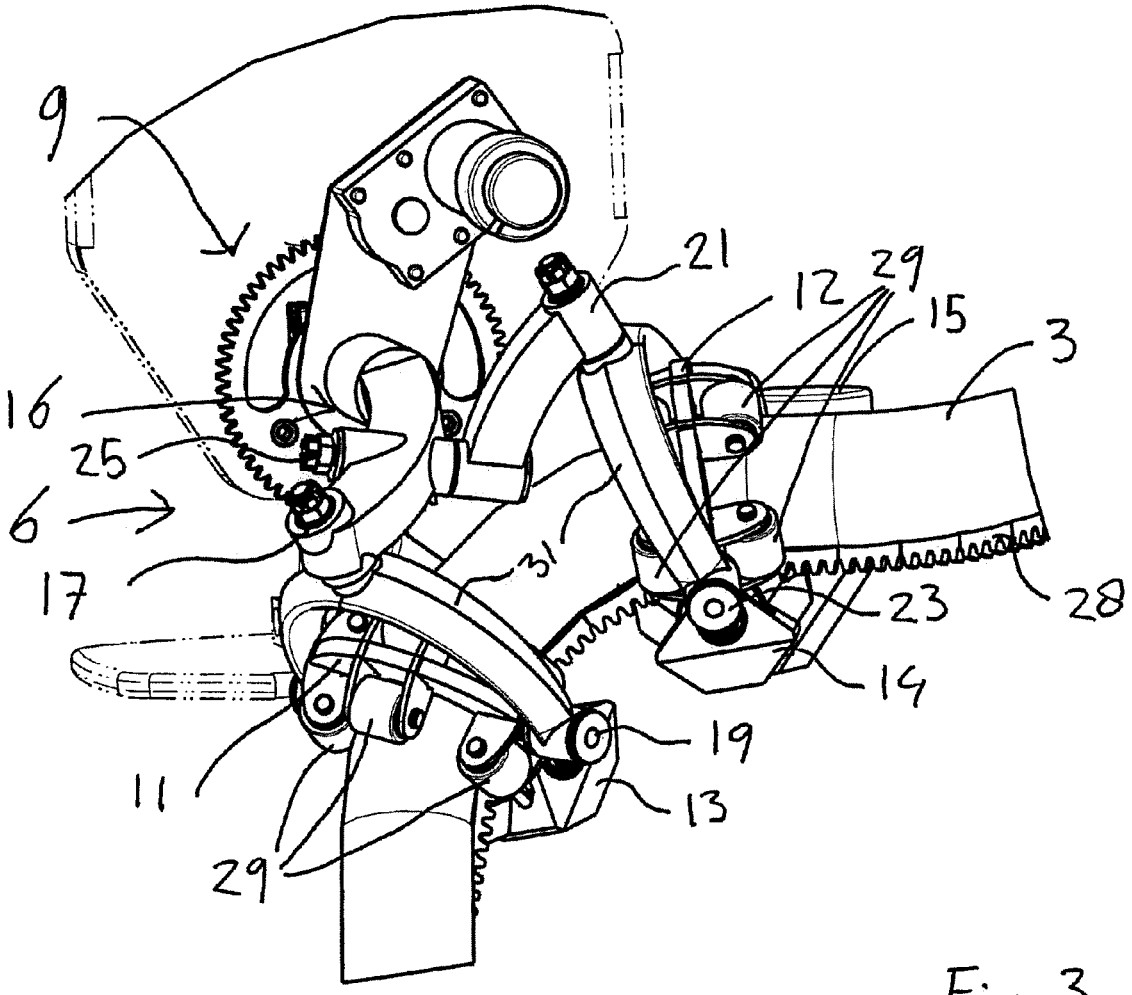

FIG. 2 shows a view in perspective of the stairlift 1 of FIG. 1 when moving along a curved section of the rail 3. The carriage housing is removed to show more details of the carriage 6. The chair forming the load bearing surface 5 is indicated by discontinuous lines. The stairlift 1 further comprises a levelling system 9 being configured to hold the load bearing surface 5 in a predetermined orientation during the movement along the rail 3 by rotating the load bearing surface 5 about a levelling rotation axis. The levelling system 9 may be covered by a housing. In the shown embodiment, the predetermined orientation is a horizontal orientation of the load bearing surface 5. This means that that the load bearing surface 5 is held in horizontal orientation during the movement along the rail 3 by the levelling system 9. In other examples of the stairlift 1, the predetermined orientation can have a different orientation.

Figure 4:
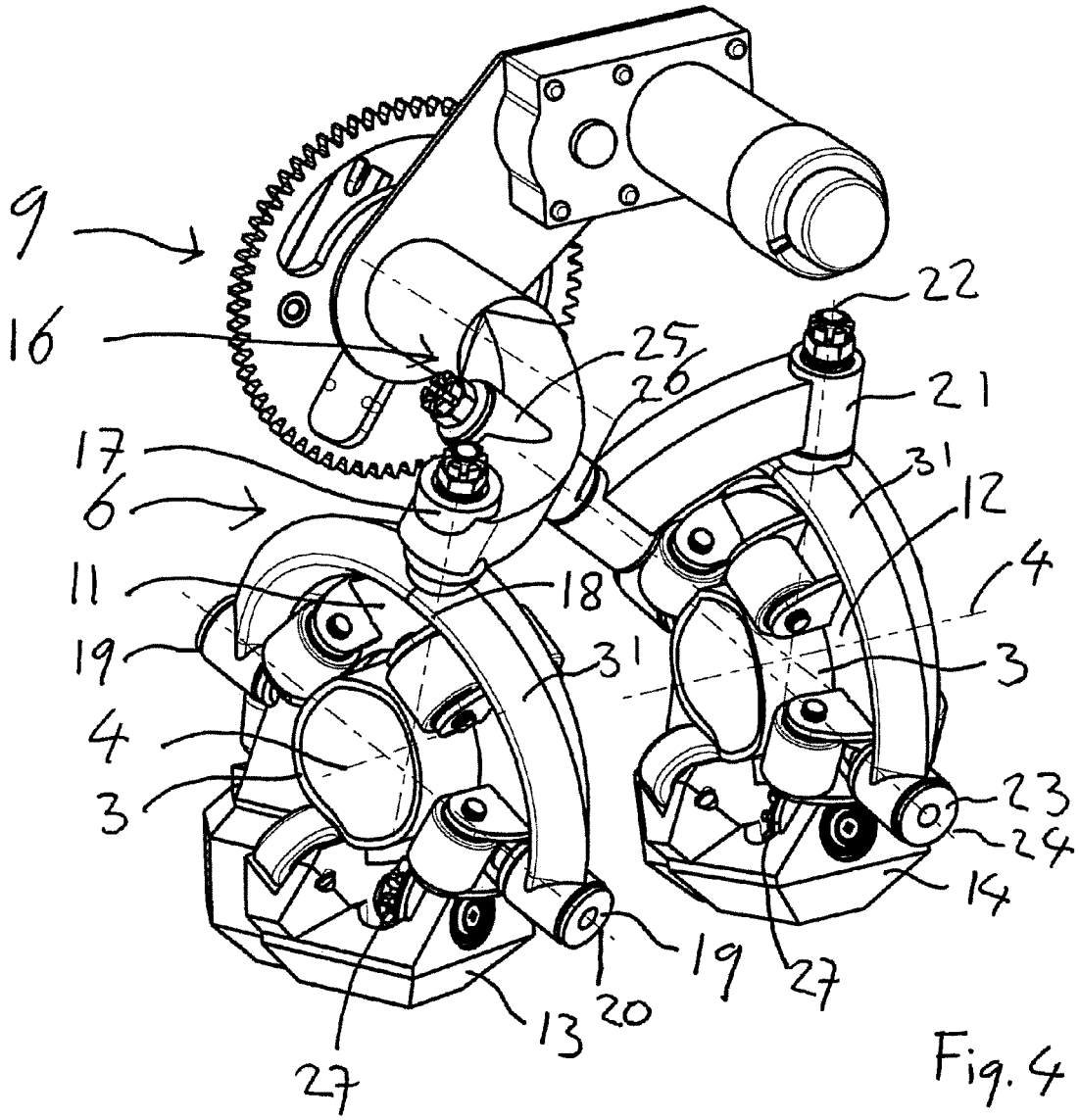
Figure 5:
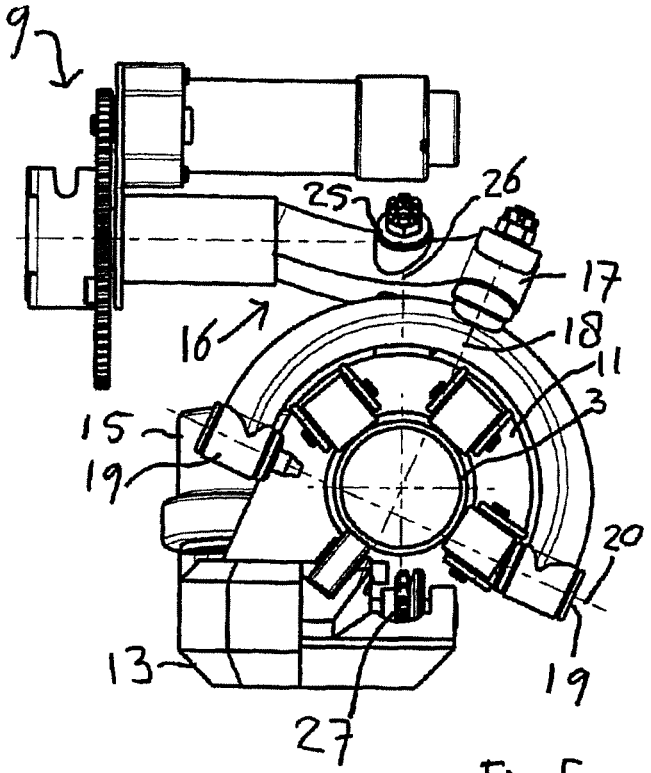
Figure 6:
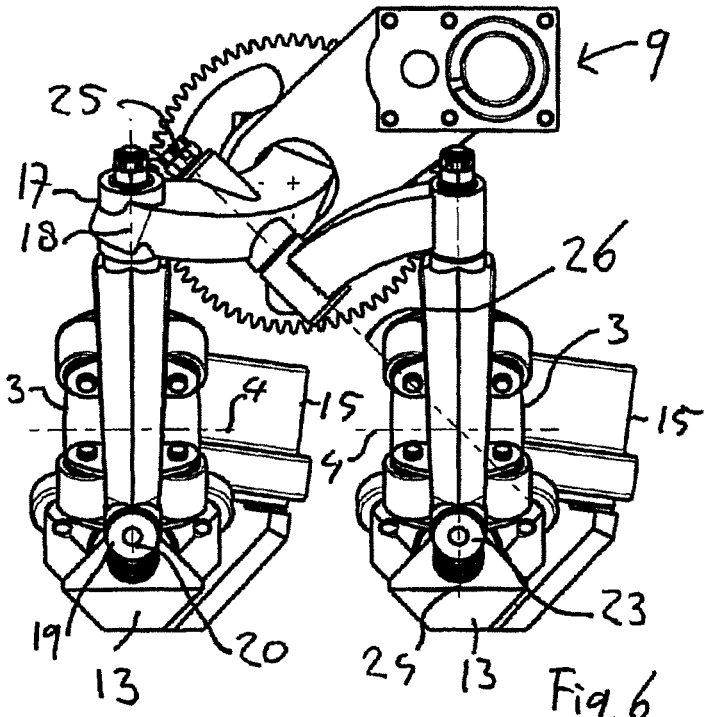

The FIGS. 3-6 show a view in perspective of the carriage according to an embodiment of the invention for use in the stairlift of FIGS. 1 and 2, but without the chair forming the load bearing surface 5. In FIGS. 4-6 portions of the rail 3 have been left away.

The FIGS. 3-6 show that the carriage 6 comprises a first guiding unit 11 and a second guiding unit 12, both engaging the rail 3. In another example of the stairlift 1, the carriage 6 comprises more than two guiding units.

The carriage 6 further comprises a first drive unit 13 and a second drive unit 14, both configured to drive the carriage 6 along the rail 3. The drive units 13, 14 may be provided with a motor 15. In an another example of the stairlift 1, the carriage 6 comprises one and only one drive unit. In yet an another example of the stairlift 1, the carriage 6 comprises more than two drive units.

The first and the second guiding unit 11, 12 may engage the rail 3 at a distance from each other when seen in a direction along the rail. The first and the second guiding unit 11, 12 may be connected to each other by a connecting unit 16. The connecting unit may also be connected to the load bearing surface via the levelling system 9. The first guiding unit may prevent the carriage to rotate around the guide rail.

The first guiding unit 11 is connected to the connecting unit 16 via a first rotation joint 17 having a first degree of freedom about a first axis 18 and a second rotation joint 19 having a second degree of freedom about a second axis 20. The first axis 18 and the second axis 20 may substantially cross each other in a second plane as shown in the figures. In this way any rotations about the first and second axis will not cause any displacements of the carriage 6.

The first and second joint may be constructed and arranged so that the first and second axis may be substantially perpendicular to each other. The first and second joint may be constructed and arranged so that the first and second axis (18, 20) substantially cross close to or on the centre line (4) at the second plane close to or on the first and second axis. The second guiding unit 12 is connected to the connecting unit 16 via a third rotation joint 21 having a third degree of freedom about a third axis 22 and a fourth joint 23 having a fourth degree of freedom about a fourth axis 24, the connection unit 16 comprises a fifth rotation joint 25 having a fifth degree of freedom about a fifth axis 26 allowing the first guiding unit 11 and the second guiding unit 12 to rotate relative to each other, wherein the fifth joint is being constructed and arranged with the fifth axis extending from outside the rail to an area close to or on the centre line 4 of the rail in a first plane close to or on the third and the fourth axis 22, 24.

By having the fifth joint 25 being constructed and arranged so that the fifth axis 26 extends from outside the rail 3 to an area close to or on the centre line 4 of the rail 3 in a first plane close to or on the third and the fourth axis 22, 24 any rotations of the second guiding unit 12 will not cause a displacement of the connecting unit 16. The stairlift 1 will therefore run more smoothly over the rail 3 and not disturb the user.

The first and the second guiding unit 11, 12 may be provided with a motor 15 driving a gear wheel 27 which is constructed and arranged to engage with a rack 28 provided to the rail 3 to move the carriage 6 up and down the rail. The gear wheels 27 engaging with the rack 28 determine the rotational position of each guiding unit 11, 12 around the rail. Since the rotational position around the rail of each guiding unit 11, 12 may vary with respect to each other there is a need to allow for rotation between the guiding units 11, 12 with a rotational bearing. For the rotational bearing it is important that the centre of rotation is close to the centre of the rail because otherwise the rotation will cause a displacement of the carriage as a function of the rotation. The guiding units 11, 12 may be further provided with rollers 29 to provide guidance along the rail 3.

The fifth joint comprises a rotational bearing being positioned at a distance from the rail. By having a rotational bearing positioned at a distance from the rail a compact design of the stairlift becomes possible. A simple rotational bearing guarantees good manufacturability and less sensibility to wear as would be the case if a ball bearing would be used having its centre of rotation on the centre line.

The third and fourth axis 22, 24 may substantially cross each other in the first plane. In this way any rotations about the third and fourth axis will not cause any displacements of the carriage 6. The third and fourth joint may be constructed and arranged so that the third and fourth axis may be perpendicular to each other.

The third and fourth joint may be constructed and arranged so that the third and fourth axis (22, 24) substantially cross close to or on the centre line (4) of the rail in the first plane. The fifth joint may be constructed and arranged with the fifth axis (26) extending from outside the rail (3) to an area close to or on the centre line (4) of the rail in a first plane close to or on the third and the fourth axis (22, 24).

The third and fourth axis 22, 24 may substantially cross the centre line 4 of the rail 3. The fifth axis 26 may also cross through the third and fourth axis 22, 24 and the centre line 4 of the rail 3. By having the fifth joint 25 being constructed and arranged so that the fifth axis 26 crosses the third axis 22, the fourth axis 24 and the centre line 4 of the rail 3 any rotations of the second guiding unit 12 will not cause a displacement of the connecting unit 16. The angle between the plane and the fifth axes may be between 0 and 90 degrees, preferably between 20 and 70 degrees, and most preferably between 30 and 60 degrees. The first, second, third and fourth joint 17, 19, 21, 23 may comprise rotational bearings. By having rotational bearings a compact design of the stairlift 1 becomes possible. A simple rotational bearing guarantees good manufacturability and is less sensible to wear.

According to an embodiment the first and second joints are connected with a bracing providing for a simple design of the stairlift.

The third and fourth joints 21, 23 may be connected with a bracing 31 providing for a simple design of the stairlift. The first and second joint 17, 19 may also be connected with a brace 31. The second and the fourth joint 19, 23 are provided with double rotational bearings each rotational bearing provided op opposite sides of the rail 3. By providing two rotational bearings on opposite side of the rail 3 a stabile rotational joint may be provided about the respective axis.

Close may be defined as preferably within 25 cm, more preferably within 5 cm and most preferably within 1 cm. The closer the better the characteristics during movement of the carriage 6 may be. 19. The rail may have a circular, elliptical, or polygonal cross section.

Figure 7:
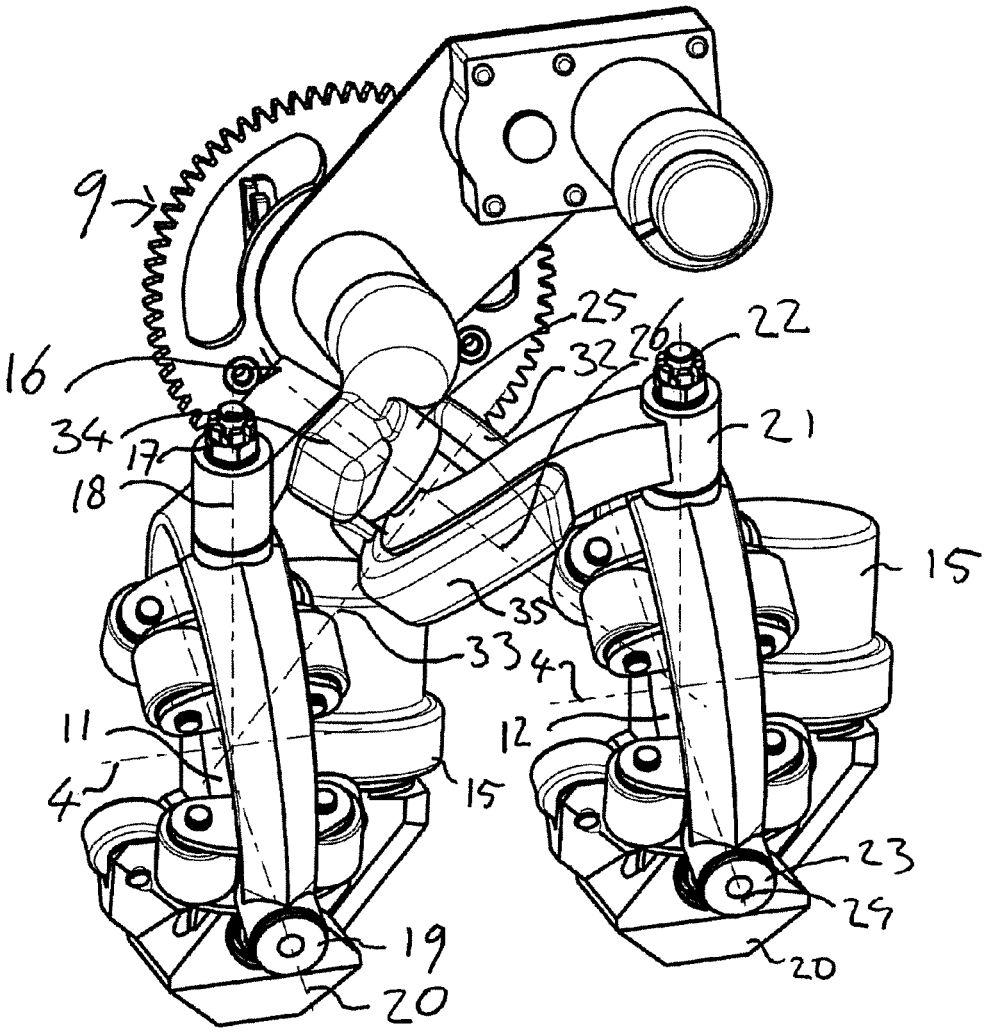
Figure 8:
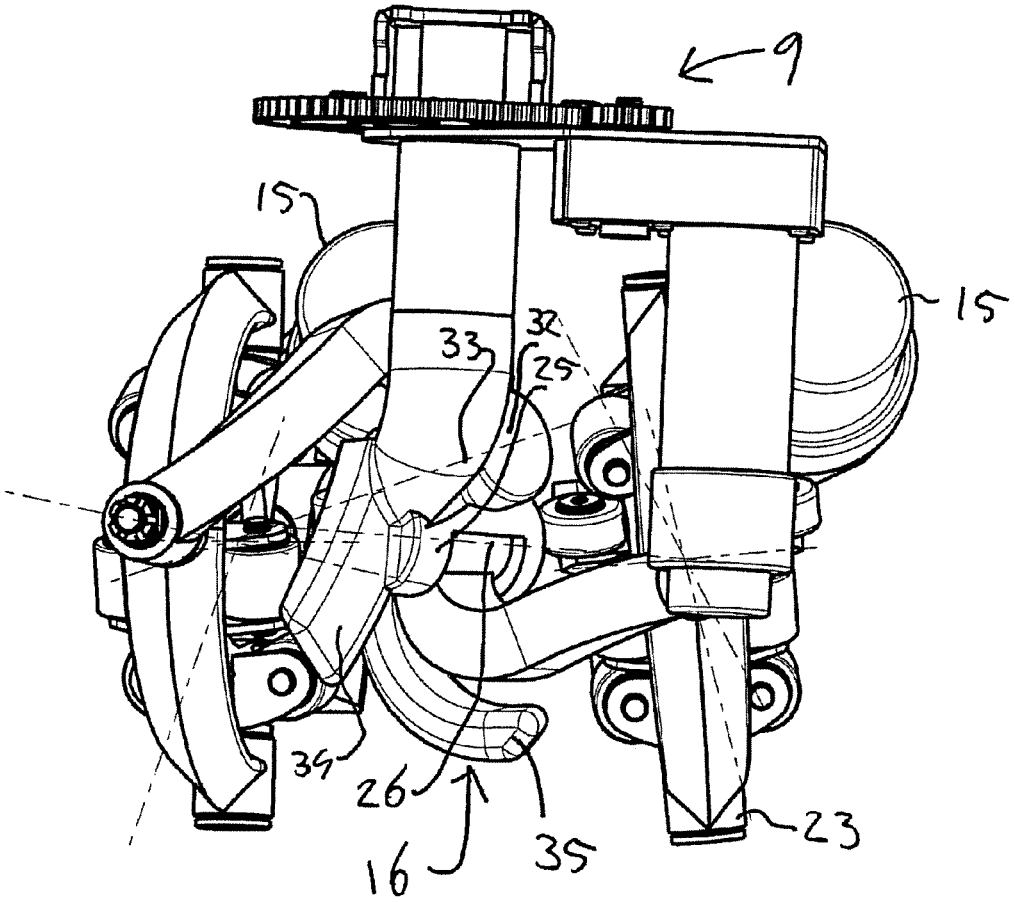

FIGS. 7 and 8 schematically show a view in perspective of a carriage according to a further embodiment of the invention for use in the stairlift of FIG. 1 at different angles. The carriage 6 according to the further embodiment of the invention is the same as the carriage 6 in FIGS. 3-6 except that the connection unit 16 comprises a sixth rotation joint 32 having a sixth degree of freedom about a sixth axis 33 allowing the first guiding unit 11 and the second guiding unit 12 to rotate relative to each other, the sixth rotation joint 32 being constructed and arranged with the sixth axis 33 extending from outside the rail to an area close to or on the centre line 4 of the rail in a second plane close to or on the first and the second axis 18, 20.

By having the sixth joint 32 being constructed and arranged so that the sixth axis 33 extends from outside the rail to an area close to or on the centre line 4 of the rail in a plane close to or on the first and the second axis 18, 20 any rotations of the first guiding unit 11 will not cause a displacement of the connecting unit 16. The stairlift will therefore run more smoothly over the rail and not disturb the user.

The first and second axis 18, 20 may substantially cross each other in the second plane. In this way any rotations about the first and second axis will not cause any displacements of the carriage. The first and second axis may be perpendicular to each other.

The first and second axis 18, 20 substantially cross the centre line 4 of the rail.

The first, second and sixth axis 18, 20, 33 substantially cross through the centre line 4 of the rail. By having the sixth joint 32 being constructed and arranged so that the sixth axis crosses the first, second axis 18, 20 and the centre line 4 of the rail any rotations of the first 11 guiding unit will not cause a displacement of the connecting unit 16.

The second guiding unit 12 is connected to the connecting unit 16 via a third rotation joint 21 having a third degree of freedom about a third axis 22 and a fourth joint 23 having a fourth degree of freedom about a fourth axis 24, the connection unit 16 comprises a fifth rotation joint 25 having a fifth degree of freedom about a fifth axis 26 allowing the first guiding unit 11 and the second guiding unit 12 to rotate relative to each other, wherein the fifth joint is being constructed and arranged with the fifth axis extending from outside the rail to an area close to or on the centre line 4 of the rail in a first plane close to or on the third and the fourth axis 22, 24. The fifth rotation joint 25 is provided with a rotation limiter 35 for limiting the rotation about the fifth axis 26. The sixth rotation joint 32 is provided with a rotation limiter 34 for limiting the rotation about the sixth axis 33. The limiters 35, 34 may comprise a stop. A stop provides a simple limiter for the rotations about the fifth and or sixth axis.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the device and method without departing from the scope as defined in the claims.

The invention claimed is:

1. A stairlift for moving a load, such as a person or goods, along a staircase, which stairlift comprises:

a curved rail configured to extend along the staircase and having a centre line;

a load bearing surface, such as a seat of a chair or a platform, to carry the load; and a carriage for moving the load along the rail, which carriage comprises a first and a second guiding unit engaging the rail;

wherein rollers in the first guiding unit and rollers in the second guiding unit engage the rail at a distance from each other when seen in a direction along the rail;

wherein the first and the second guiding units are connected to each other by a connecting unit, wherein the first guiding unit is connected to the connecting unit via a first rotation joint having a first degree of freedom about a first axis and a second rotation joint having a second degree of freedom about a second axis, wherein the second guiding unit is connected to the connecting unit via a third rotation joint having a third degree of freedom about a third axis and a fourth joint having a fourth degree of freedom about a fourth axis, the connection unit comprises a fifth rotation joint having a fifth degree of freedom about a fifth axis allowing the first guiding unit and the second guiding unit to rotate relative to each other;

wherein the fifth joint is being constructed and arranged with the fifth axis extending transverse to the centre line from outside the rail to an area close to or on the centre line of the rail in a first plane close to or on the third and the fourth axis; and wherein the third and fourth joint are constructed and arranged so that the third and fourth axis substantially cross each other in the first plane.

2. The stairlift according to claim 1, wherein the fifth joint comprises a rotational bearing being positioned at a distance from the rail.

3. The stairlift according to claim 1, wherein the third and fourth joint are constructed and arranged so that the third and fourth axis substantially cross the centre line of the rail.

4. The stairlift according to claim 3, wherein the third, fourth and fifth joint are constructed and arranged so that the third, fourth and fifth axis substantially cross through the centre line of the rail.

5. The stairlift according to claim 1, wherein the first, second, third and fourth joint comprise rotational bearings.

6. The stairlift according to claim 1, wherein the fifth rotation joint is provided with a rotation limiter for limiting the rotation about the fifth axis.

7. The stairlift according to claim 6, wherein the limiter for limiting the rotation about the fifth and or sixth axis comprises a stop.

8. The stairlift according to claim 1, wherein at least one of the first and the second guiding unit is provided with a motor driving a gear wheel which is constructed and arranged to engage with a rack provided to the rail to move the carriage up and down the rail.

9. A stairlift for moving a load, such as a person or goods, along a staircase, which stairlift comprises:

a curved rail configured to extend along the staircase and having a centre line;

a load bearing surface, such as a seat of a chair or a platform, to carry the load; and a carriage for moving the load along the rail, which carriage comprises a first and a second guiding unit engaging the rail;

wherein rollers in the first guiding unit and rollers in the second guiding unit engage the rail at a distance from each other when seen in a direction along the rail;

wherein the first and the second guiding units are connected to each other by a connecting unit, wherein the first guiding unit is connected to the connecting unit via a first rotation joint having a first degree of freedom about a first axis and a second rotation joint having a second degree of freedom about a second axis, wherein the second guiding unit is connected to the connecting unit via a third rotation joint having a third degree of freedom about a third axis and a fourth joint having a fourth degree of freedom about a fourth axis, the connection unit comprises a fifth rotation joint having a fifth degree of freedom about a fifth axis allowing the first guiding unit and the second guiding unit to rotate relative to each other;

wherein the fifth joint is being constructed and arranged with the fifth axis extending transverse to the centre line from outside the rail to an area close to or on the centre line of the rail in a first plane close to or on the third and the fourth axis;

wherein the connection unit comprises a sixth rotation joint having a sixth degree of freedom about a sixth axis allowing the first guiding unit and the second guiding unit to rotate relative to each other, the sixth rotation joint being constructed and arranged with the sixth axis extending from outside the rail to an area close to or on the centre line of the rail in a second plane close to or on the first and the second axis; and wherein the first and second joint are constructed and arranged so that the first and second axis substantially cross the centre line of the rail.

10. The stairlift according to claim 9, wherein the first and second joint are constructed and arranged so that the first and second axis substantially cross each other in the second plane.

11. The stairlift according to claim 9, wherein the sixth rotation joint is provided with a rotation limiter for limiting the rotation about the sixth axis.

12. A stairlift for moving a load, such as a person or goods, along a staircase, which stairlift comprises:

a curved rail configured to extend along the staircase and having a centre line;

a load bearing surface, such as a seat of a chair or a platform, to carry the load; and a carriage for moving the load along the rail, which carriage comprises a first and a second guiding unit engaging the rail;

wherein rollers in the first guiding unit and rollers in the second guiding unit engage the rail at a distance from each other when seen in a direction along the rail;

wherein the first and the second guiding units are connected to each other by a connecting unit, wherein the first guiding unit is connected to the connecting unit via a first rotation joint having a first degree of freedom about a first axis and a second rotation joint having a second degree of freedom about a second axis, wherein the second guiding unit is connected to the connecting unit via a third rotation joint having a third degree of freedom about a third axis and a fourth joint having a fourth degree of freedom about a fourth axis, the connection unit comprises a fifth rotation joint having a fifth degree of freedom about a fifth axis allowing the first guiding unit and the second guiding unit to rotate relative to each other;

wherein the fifth joint is being constructed and arranged with the fifth axis extending transverse to the centre line from outside the rail to an area close to or on the centre line of the rail in a first plane close to or on the third and the fourth axis;

wherein the connection unit comprises a sixth rotation joint having a sixth degree of freedom about a sixth axis allowing the first guiding unit and the second guiding unit to rotate relative to each other, the sixth rotation joint being constructed and arranged with the sixth axis extending from outside the rail to an area close to or on the centre line of the rail in a second plane close to or on the first and the second axis; and wherein the first, second and sixth joint are constructed and arranged so that the first, second and sixth axis substantially cross through the centre line of the rail.

* * * * *